United States Patent [19]

Goodman et al.

[11] 4,044,712

[45] Aug. 30, 1977

[54] PRESSURIZED FLUID POWERED HORN

[76] Inventors: Manuel Goodman; Boubene M. Jaremus, both of 3410 N. Lake Shore Drive, Chicago, Ill. 60657

[21] Appl. No.: 684,287

[22] Filed: May 7, 1976

[51] Int. Cl.[2] ..... G08B 3/00; G10K 9/00

[52] U.S. Cl. ..... 116/142 FP; 116/112; 222/3; 222/517

[58] Field of Search ..... 116/142 FP, 112; 239/579; 222/3, 5, 39, 183, 160, 175, 517

[56] References Cited

U.S. PATENT DOCUMENTS

| | | | |
|---|---|---|---|
| 3,000,344 | 9/1961 | Farrell | 116/112 |
| 3,180,524 | 4/1965 | Shepard et al. | 222/5 |
| 3,244,137 | 4/1966 | Garvey | 116/112 X |
| 3,254,803 | 6/1966 | Meshberg | 222/183 X |
| 3,598,324 | 8/1971 | Macguire-Cooper | 239/579 X |
| 3,690,286 | 9/1972 | Gantt | 116/112 X |
| 3,732,843 | 5/1973 | Pappas et al. | 116/112 X |

*Primary Examiner*—Daniel M. Yasich

[57] ABSTRACT

A hand-held pressurized fluid powered audible alarm includes a housing in which is mounted a pressurized container having a deflection responsive valve and outlet member projecting therefrom. A horn body is mounted on and in fluid communication with the member and a spring loaded plunger carried by the housing is provided to contact and displace the horn body thereby deflecting the member to supply pressurized fluid for sounding the alarm. The plunger is normally retained spaced from the alarm by a removeable pin passing transversely through the plunger shaft. A ring coupled to the pin is pulled to rapidly remove the pin and irreversibly activate the alarm.

1 Claim, 1 Drawing Figure

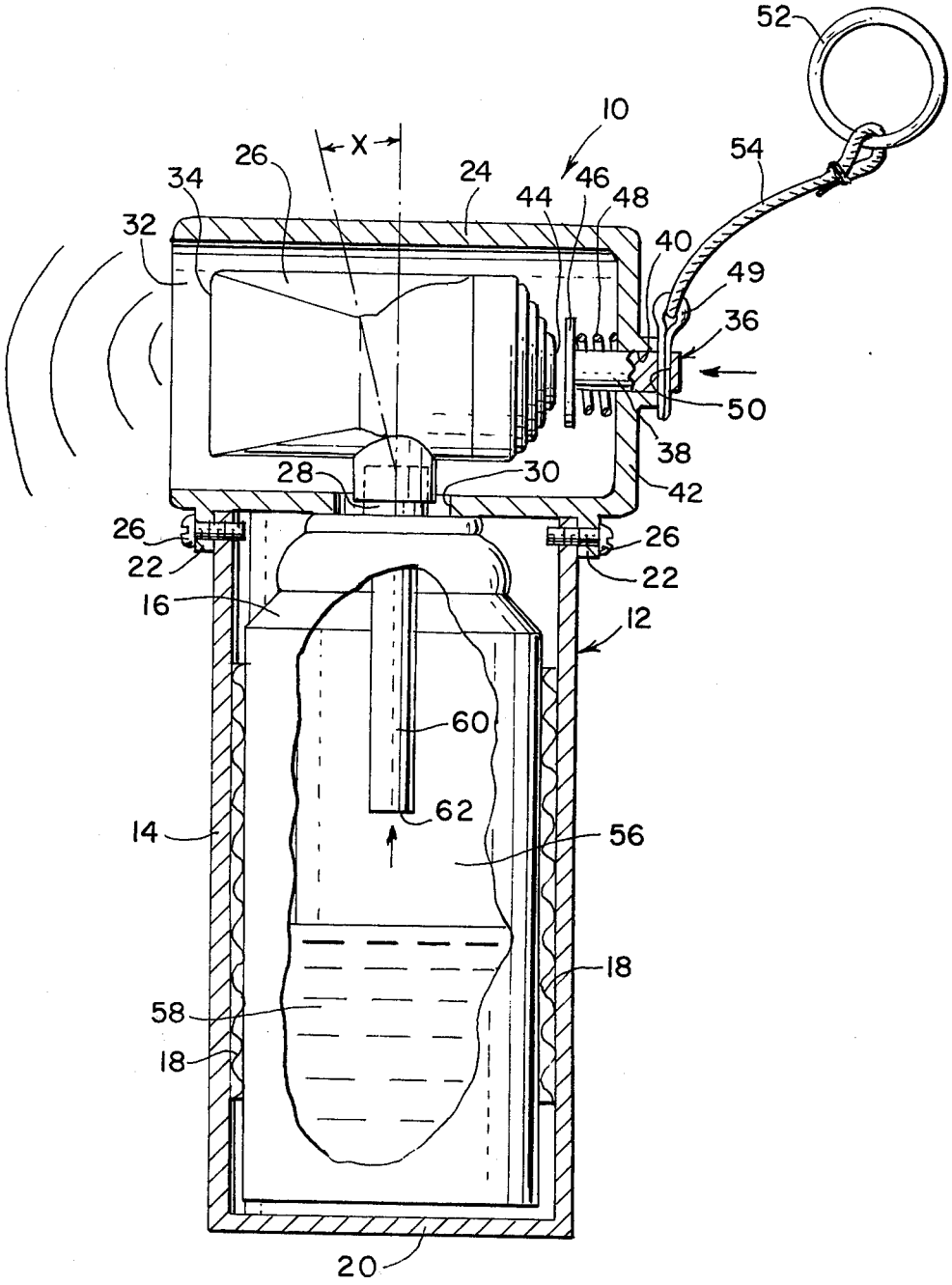
52
10
54
X
26
24
34
44
46
48
32
40
49
36
50
38
28
30
42
26
26
22
22
16
12
60
62
14
56
18
58
18
20

PRESSURIZED FLUID POWERED HORN

FIELD OF THE INVENTION

The present invention relates generally to pressurized fluid powered audible alarms. In its particular aspects the present invention relates to a pressurized fluid powered alarm which is irreversibly activated by pulling a removeable member from the alarm via a pull ring coupled thereto.

BACKGROUND OF THE INVENTION

A hand held audible alarm is useful in areas having a high incidence of robberies and assault for warding off or at least distracting would-be attackers.

While various pressurized fluid powered horns have heretofore been suggested they generally suffer from the disability of requiring constant actuation or are easily turned off.

OBJECTS OF THE INVENTION

It is an object of the present invention to provide a pressurized fluid powered alarm which may be irreversibly actuated by pulling a removeable part from the alarm via a pull ring.

It is a further object of the present invention to provide a hand holdable alarm which may be carried in a pocket or purse.

It is another object of the present invention to provide an alarm device for producing a loud alarm over a relatively long period of time, which device is capable of operation in any orientation relative to gravity.

SUMMARY OF THE INVENTION

Briefly, the aforementioned and other objects of the present invention are satisfied by providing a pressurized fluid powered alarm device which includes a housing in which a pressurized fluid container is mounted. The container has a deflection responsive valve and outlet member projecting therefrom for selectively dispensing the pressurized fluid. A horn body is mounted on the member for receiving pressurized fluid therefrom the powering the horn.

A plunger is carried slideably by the housing adjacent the horn body. Spring means acting between the horn body and the housing urges the plunger to contact and displace the horn thereby deflecting the member. A removeable pin is provided passing transversely through the plunger shaft on the outside of the housing to retain the plunger in a normal position spaced from the horn body. By pulling a ring coupled to the pin, the pin is removed and the plunger is released to displace the horn body and activate the alarm.

When the pin is removed the plunger shaft disappears into the housing preventing it from being engaged to deactivate the alarm.

In order that the alarm be both loud and of long duration and yet be packaged in a small size, the pressurized container is filled with a pressurized fluid such as FREON which may have both liquid and gaseous phases. It will be appreciated that the existence of a liquid phase insures a large potential volume of gas. To prevent the liquid phase from being directly supplied to the aforementioned valve and outlet member; a tubular intake duct projects from the member to a location generally in the center of the container interior. The volume of the liquid phase is chosen that with any orientation of the alarm relative to gravity, the liquid will not contact the open end of the duct.

Other objects, features and advantages of the present invention will become apparent upon perusal of the following detailed description of the preferred embodiment thereof when taken in conjunction with the appended drawing wherein:

BRIEF DESCRIPTION OF THE DRAWING

The sole FIGURE is an elevational central cross-sectional view of the pressurized fluid alarm device of the present invention.

DETAILED DESCRIPTION

Referring to the drawing, the pressurized fluid powered alarm device of the present invention is generally indicated by the reference numeral 10. The alarm device 10 comprises a housing 12 including a cylindrical handle 14 in which is retained a replaceable cylindrical container 16 of pressurized fluid. The container 16 is preferably coaxially surrounding by a corrugating packing 18 of shock absorbing material such as cardboard.

One end of handle 14 is closed by an end wall 20 while the other end of the handle is open and is received in a tubular collar 22 carried by a housing portion 24 in which is located a horn body 26. The housing portion 24 and handle 14 are secured together by plural radially directed screws 26 passing through collar 22 and threadably through handle 14.

The container 16 has a conventional deflection responsive valve and outlet member 28 projecting therefrom through an opening in 30 in housing portion 24 and into the interior of the housing portion. The horn body 26 is mounted directly on member 28 in fluid communication therewith. Thus, the horn body 26 will receive pressurized fluid to activate alarm 10 if the horn should be displaced for deflecting member 28 through a small angle X. The manner of construction of horn 26 and of mounting the horn on member 28 is well known in the art. Preferably the horn body and mounting arrangement therefor are the same as disclosed in U.S. Pat. No. 3,670,689 to Michael Pappas, issued June 20, 1972.

The housing portion 24 surrounds horn body 26 except for an opening 32 therein opposite the mouth 34 of the horn body. A plunger 36 includes a shaft 38 mounted slideably in a bore 40 through a wall 42 of housing portion 24 opposite a rear end 44 of horn body 26. The plunger 36 is coaxial with horn body 26 and includes an enlarged circular flange 46 adapted to contact rear end 44. A helical compression spring 48 is disposed coaxially about shaft 38 and acts between flange 46 and wall 42 to push flange 46 against the horn body 26 for displacing the horn body toward the opening 32 thereby deflecting member 28 sufficiently to release pressurized fluid through the horn body.

The flange 46 is normally retained spaced from the rear end 44 of horn body 26 by a removeable cotter pin 49 passing through a transverse bore 50 in a portion of shaft 38 which is exposed on the outside of housing portion 24. A pull ring 52 is provided coupled to pin 49 via a short length of cord 54.

By gripping the ring 52, the pin 49 may be rapidly pulled out of bore 50. Then spring 48 will slide the plunger 36 to contact and displace horn body 26 for sounding the alarm. Upon this movement of plunger 36, the shaft 38 retracts into bore 40 sufficiently so as not to be exposed. Therefore, the shaft 38 cannot be engaged to turn off alarm device 10.

It should now be apparent that when pin 49 is removed from device 10, the device is irreversibly activated. For producing a loud signal of long duration through horn body 26, it is necessary to have a potentially relatively large supply of gas in container 16. To this end, a suitable fluid such as FREON is used which may be pressurized to have a gas phase 56 and a liquid phase 58. As fluid from the gas phase leaves the container 16 through member 28, the gas phase is replenished from the liquid phase. Thus, a large supply of gas is assured because of the high molecular density of the liquid phase 58.

To insure that the liquid phase 58 does not directly exit container 16 via member 28, when the device 10 is either upside down or on its side, an elongated tubular intake duct 60 is directed from member 28 into the center of container 16. The open end 62 of duct 60 remote from member 28 is positioned so as not to be in contact with the liquid phase 58 in any orientation of device 10 relative to gravity. This is done by selecting the volume of liquid phase 58 to take up less than half of container 16 and making the length of duct 60 equal to one half the height of the container.

While the preferred embodiment of the present invention has been described in specific detail, it should be understood that numerous modifications, additions and omissions in the details thereof are possible within the intended spirit and scope of the invention claimed herein.

What is claimed is:

1. A pressurized fluid powered audible alarm device comprising: a housing; a container of pressurized fluid mounted in said housing, said container having a deflection responsive valve and outlet member projecting therefrom for selectively dispensing said pressurized fluid from said container through said valve and outlet member in response to displacement of said valve and outlet member in a predetermined direction; a horn mounted on said outlet member for receiving said pressurized fluid; said horn being excited to sound in response to pressurized fluid passing through said horn; said horn receiving pressurized fluid in response to displacement of said horn relative to said housing in said predetermined direction and consequent deflection of said valve and outlet member; a plunger carried slideably by said housing proximate said horn and being positioned for selectively approaching said horn from a direction opposite said predetermined direction; spring means acting between said plunger and said horn for urging said plunger to contact and displace said horn in said predetermined direction; removeable means for retaining said plunger spaced from said horn against the urging of said spring means; said removeable means including a pull ring to facilitate rapid removal of said removeable means; said pressurized fluid in said container having a liquid phase and a gaseous phase; a tubular intake duct within said container; one end of said duct being connected to said valve and outlet member, the other end of said duct being open and being positioned in said container; the volume of said liquid phase and the length of said duct being selected to be of a preselected volume and length, respectively, for preventing said liquid phase from contacting the open end of said duct in any orientation of said device.

* * * * *